US011910966B2

(12) United States Patent
Yang

(10) Patent No.: US 11,910,966 B2
(45) Date of Patent: Feb. 27, 2024

(54) FOLDING TOILET STEP STOOL

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 385 days.

(21) Appl. No.: 17/244,983

(22) Filed: Apr. 30, 2021

(65) Prior Publication Data

US 2021/0353115 A1 Nov. 18, 2021

(30) Foreign Application Priority Data

May 12, 2020 (CN) ..... 202020779008.3

(51) Int. Cl.

*A47K 13/06* (2006.01)
*A47C 12/00* (2006.01)
*A47C 12/02* (2006.01)

(52) U.S. Cl.

CPC ..... *A47K 13/06* (2013.01); *A47C 12/00* (2013.01); *A47C 12/02* (2013.01)

(58) Field of Classification Search

CPC ..... A47K 13/06; A47C 12/00; A47C 12/02
USPC ..... 4/237, 239, 254, 902; D23/296
See application file for complete search history.

(56) References Cited

U.S. PATENT DOCUMENTS 4,777,672 A * 10/1988 Gebhard ..... A47K 13/06 4/449
D570,461 S * 6/2008 Desnos-Simon ..... D23/296

FOREIGN PATENT DOCUMENTS

CN 101119674 A * 2/2008 ..... A47K 13/06
DE 202007002625 U1 * 8/2007 ..... A47K 13/06

* cited by examiner

*Primary Examiner* — Tuan N Nguyen
(74) *Attorney, Agent, or Firm* — Bayramoglu Law Offices LLC

(57) ABSTRACT

A folding toilet step stool includes a seat cushion ring and an elevated ladder. The elevated ladder includes a left support rod, a right support rod, a bottom plate and a pedal. The front portion of the seat cushion ring is hinged to the upper portion of the left support rod and the upper portion of the right support rod. The bottom of the left support rod and the bottom of the right support rod are hinged to the bottom plate. The pedal is hinged between the middle of the left support rod and the middle of the right support rod. The left support rod and the right rod are disposed obliquely. The bottom plate is placed on the floor and the seat cushion ring is placed on the toilet, so that children can sit on the seat cushion ring with their feet on the pedal for urination or defecation.

6 Claims, 6 Drawing Sheets

FOLDING TOILET STEP STOOL

CROSS REFERENCE TO THE RELATED APPLICATIONS

This application is based upon and claims priority to Chinese Patent Application No. 202020779008.3, filed on May 12, 2020, the entire contents of which are incorporated herein by reference.

TECHNICAL FIELD

The present invention relates to the field of children's products, and in particular to a folding toilet step stool.

BACKGROUND

In order for children to cultivate their habits of urinating or defecating in the toilet, children need to go through a potty-to-toilet transition as they grow up. At present, a considerable number of families do not specifically set up toilets that are specially designed for their children. When children use an adult-sized toilet to urinate or defecate, there comes the following problems: (1) since the adult-sized toilet is relatively high, children will feel uncomfortable when sitting on the toilet with their feet dangling on the floor; and (2) since the adult-sized toilet has a relatively large seat, children's bums are likely to fall in and/or get stuck in the seat, which is not safe to use.

SUMMARY

The present invention provides a folding toilet step stool to overcome the above-mentioned problems identified in the prior art.

The present invention is realized by adopting the following technical solution.

A folding toilet step stool includes a seat cushion ring and an elevated ladder. The elevated ladder includes a left support rod, a right support rod, a bottom plate and a pedal. The front portion of the seat cushion ring is hinged to the upper portion of the left support rod and the upper portion of the right support rod. The bottom of the left support rod and the bottom of the right support rod are hinged to the bottom plate. The pedal is hinged between the middle of the left support rod and the middle of the right support rod. The left support rod and the right rod are disposed obliquely. The length of the front portion of the pedal is greater than the length of the rear portion of the pedal. Two abutting surfaces are formed at the junctions of the front portion of the pedal and the rear portion of the pedal. The front side surface of the left support rod and the front side surface of the right support rod abut against the two abutting surfaces, respectively.

Further, a first rotating shaft is disposed inside the top of each of the left support rod and the right support rod, and the first rotating shaft is provided with a first threaded section. The front portion of each of the left side surface and the right side surface of the seat cushion ring is provided with a first rotating cylinder, and the first rotating cylinder is provided with a first threaded hole. One end of the first rotating cylinder extends into the top of the corresponding support rod. The first threaded section is correspondingly screwed to the first threaded hole. The end surface at the other end of the first rotating cylinder is provided with a first "straight slot".

Further, each of the middle of the left support rod and the middle of the right support rod is provided with a stepped through hole. The middle of each of the left side surface and the right side surface of the pedal is provided with a second rotating shaft. The second rotating shaft is provided with a second threaded section. A second rotating cylinder is disposed in the stepped through hole, and the second rotating cylinder is provided with a second threaded hole. One end of the second rotating shaft extends into the stepped through hole. The second threaded section is correspondingly screwed to the second threaded hole. An outer end surface of the second rotating cylinder is provided with a second "straight slot".

Further, the bottom plate is provided with a left receiving groove and a right receiving groove. The rear end of each of the left receiving groove and the right receiving groove is an open structure. The bottom of the left support rod and the bottom of the right support rod are located in the left receiving groove and the right receiving groove, respectively. Each of both side surfaces of each of the left receiving groove and the right receiving groove is provided with a groove and an engaging hole. The engaging hole is located beneath the groove and connected to the groove. Each of both side surfaces of each of the left support rod and the right support rod is provided with an engaged part engaged with the corresponding engaging hole. The lower end surface of the engaged part is rounded.

Further, the top surface of the pedal is provided with anti-slip protrusions.

Further, each of the left top surface and the right top surface of the seat cushion ring is provided with a wave-shaped handle. The top surface of the seat cushion ring is provided with a polyurethane (PU) pad.

Furthermore, the top outer end surface of each of the left support rod and the right support rod is provided with a decorative ring fastened thereto.

It can be seen from the above description of the present invention that the present invention has the following advantages over the prior art. The present invention has a novel structure and ingenious design. Specifically, the bottom plate is placed on the floor and the seat cushion ring is placed on the toilet, so that children can sit on the seat cushion ring with their feet on the pedal for urination or defecation, rather than dangling on the floor, which avoids the safety problem caused by the relatively large seat of the toilet when the child sits on the seat cushion ring. When the toilet step stool is not in use, the left support rod and the right support rod can be rotated to be perpendicular to the bottom plate, and then the seat cushion ring and the pedal are rotated to an appropriate position where the toilet step stool is minimum in size, thereby minimizing the space occupied.

DETAILED DESCRIPTION OF THE EMBODIMENTS

Figure 1:
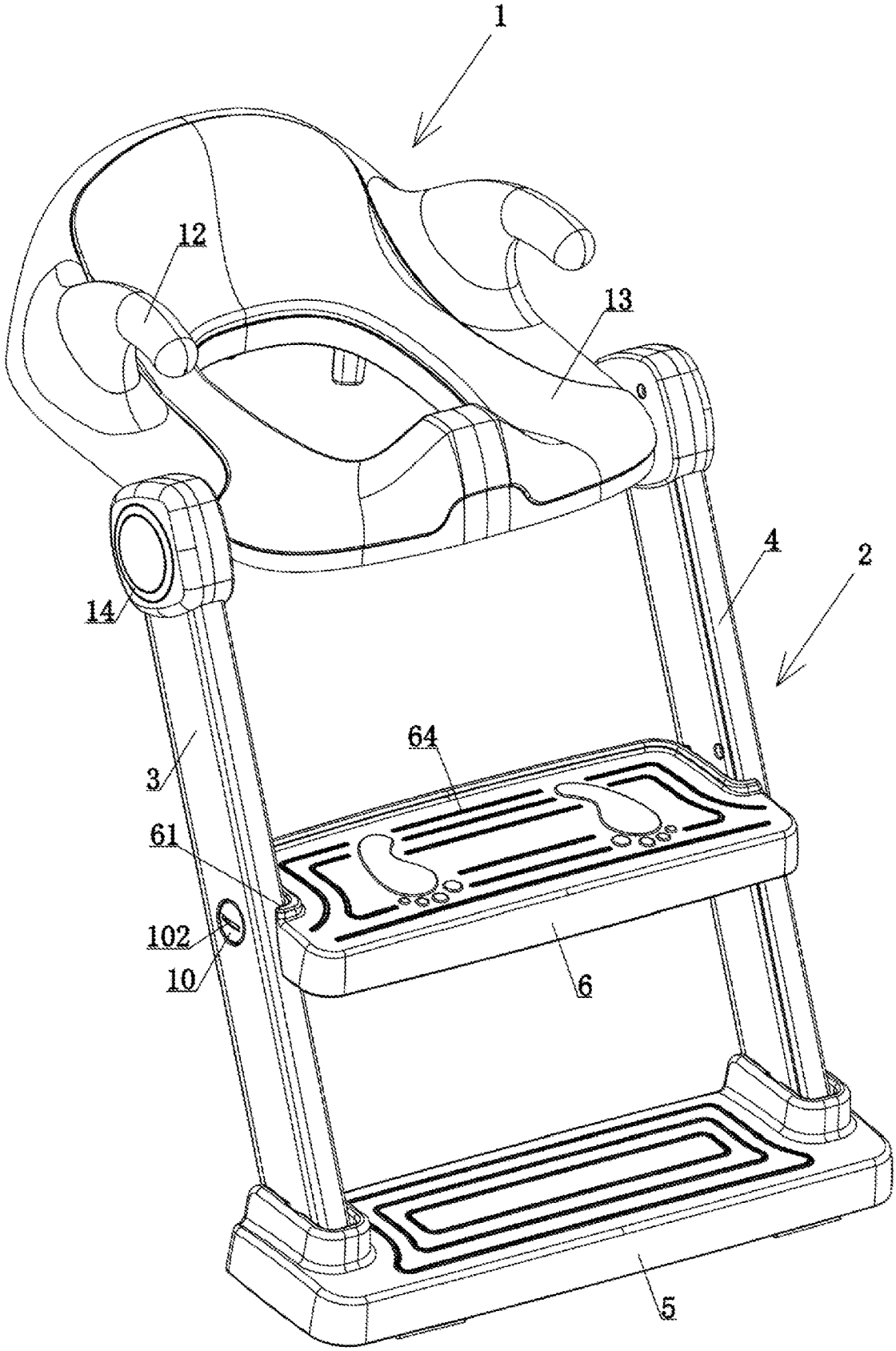
FIG. 1 is a structural diagram of the present invention.
Figure 2:
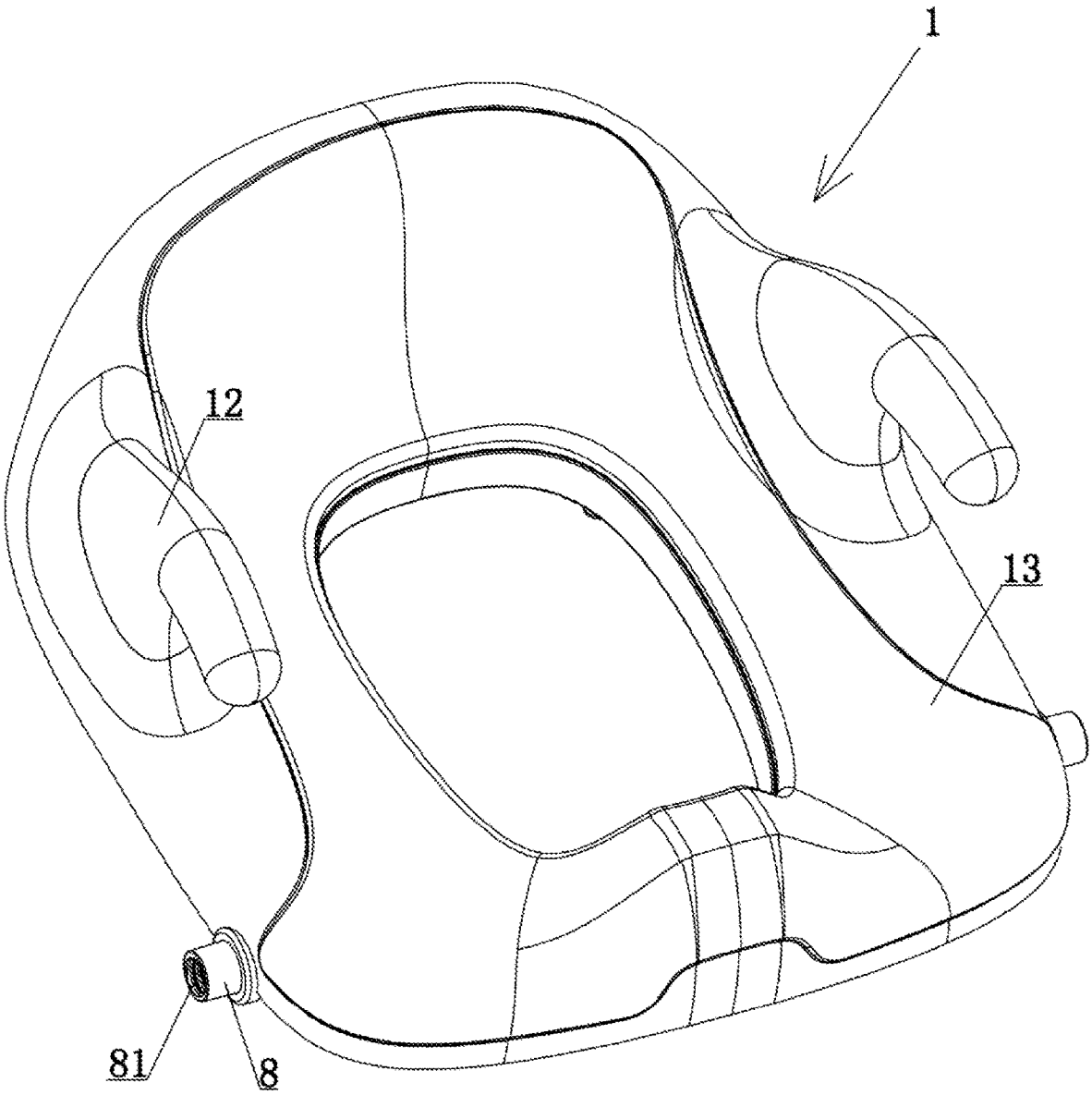
FIG. 2 is a structural diagram of a seat cushion ring of the present invention.
Figure 3:
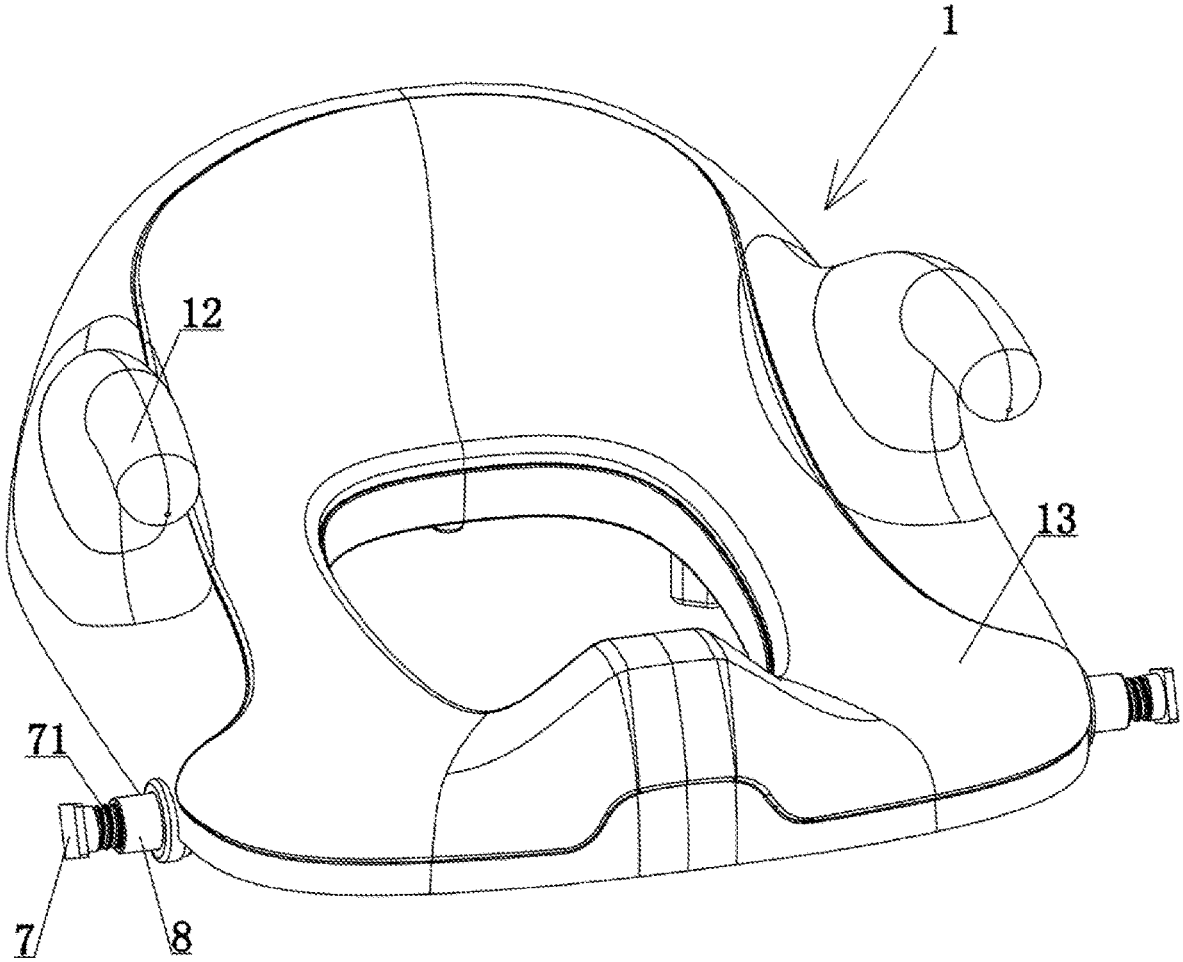
FIG. 3 is a structural diagram of the seat cushion ring fitted with a first rotating shaft of the present invention.
Figure 4:
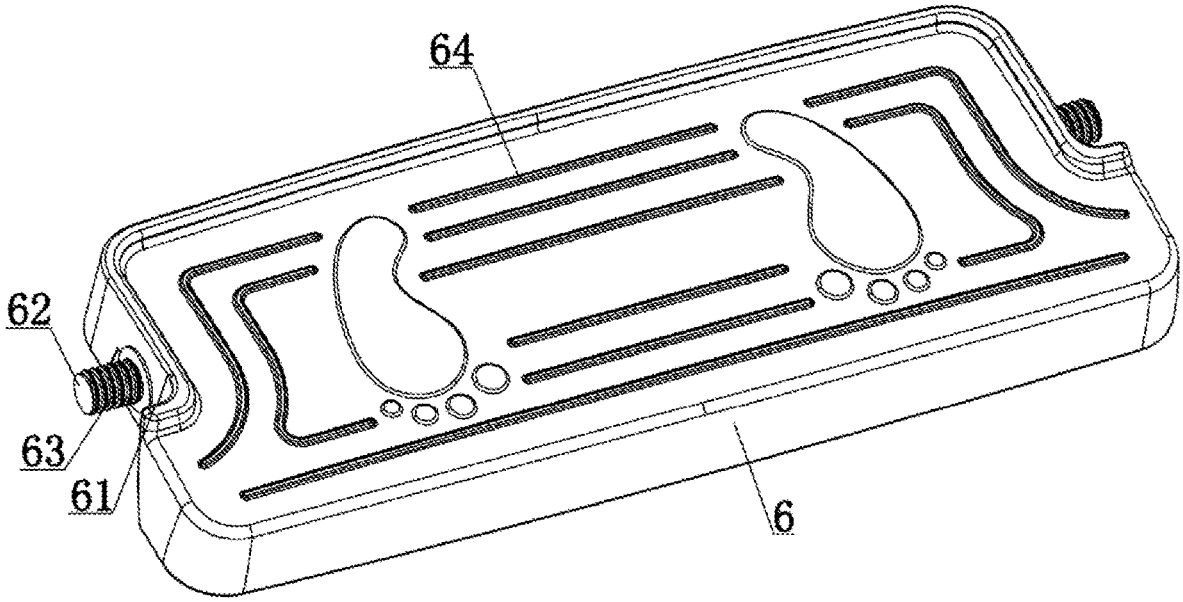
FIG. 4 is a structural diagram of a pedal of the present invention.
Figure 5:
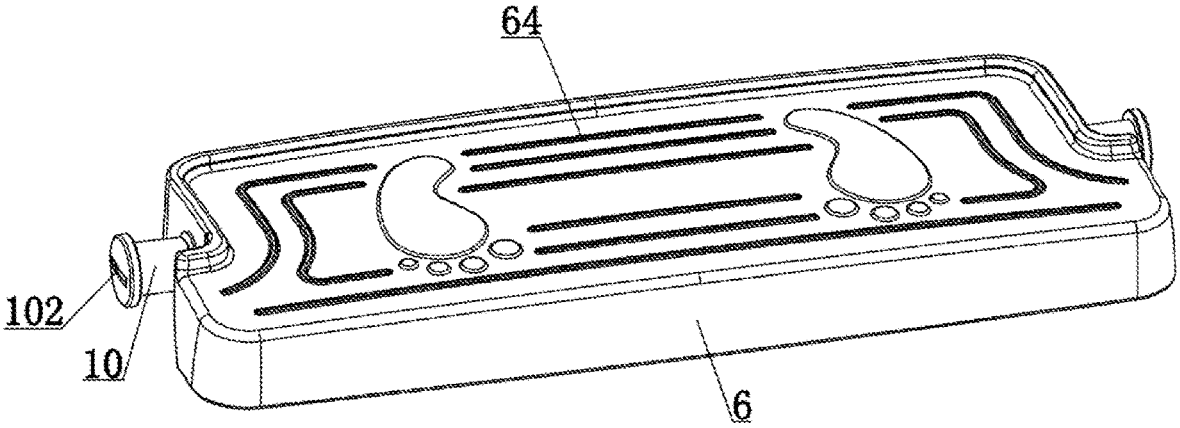
FIG. 5 is a structural diagram of the pedal fitted with a second rotating cylinder of the present invention.

Referring to FIG. 1, a folding toilet step stool includes the seat cushion ring 1 and the elevated ladder 2. The elevated ladder 2 includes the left support rod 3, the right support rod 4, the bottom plate 5 and the pedal 6. The front portion of the seat cushion ring 1 is hinged to the upper portion of the left support rod 3 and the upper portion of the right support rod 4. The bottom of the left support rod 3 and the bottom of the right support rod 4 are hinged to the bottom plate 5. The pedal 6 is hinged between the middle of the left support rod 3 and the middle of the right support rod 4. The left support rod 3 and the right support rod 4 are disposed obliquely. The length of the front portion of the pedal 6 is greater than the length of the rear portion of the pedal 6. Two abutting surfaces 61 are formed at the junctions of the front portion of the pedal 6 and the rear portion of the pedal 6. The front side surface of the left support rod 3 and the front side surface of the right support rod 4 abut against the two abutting surfaces, respectively.

Referring to FIGS. 1, 2, 3, 4, 6, 7 and 8. The first rotating shaft 7 is disposed inside the top of each of the left support rod 3 and the right support rod 4, and the first rotating shaft 7 is provided with the first threaded section 71. The front portion of each of the left side surface and the right side surface of the seat cushion ring 1 is provided with the first rotating cylinder 8, and the first rotating cylinder 8 is provided with the first threaded hole 81. One end of the first rotating cylinder 8 extends into the top of the corresponding support rod, and the first threaded section 71 is correspondingly screwed to the first threaded hole 81. The end surface at the other end of the first rotating cylinder 8 is provided with the first "straight slot" 82. Each of the middle of the left support rod 3 and the middle of the right support rod 4 is provided with the stepped through hole 9. The middle of each of the left side surface and the right side surface of the pedal 6 is provided with the second rotating shaft 62, and the second rotating shaft 62 is provided with the second threaded section 63. The second rotating cylinder 10 is disposed in the stepped through hole 9, and the second rotating cylinder 10 is provided with the second threaded hole 101. One end of the second rotating shaft 62 extends into the stepped through hole 9, and the second threaded section 63 is correspondingly screwed to the second threaded hole 101. An outer end surface of the second rotating cylinder 10 is provided with the second "straight slot" 102. The first "straight slot" 82 and the second "straight slot" 102 facilitate the screwing between the first rotating cylinder 8 and the first rotating shaft 7 and the screwing between the second rotating cylinder 10 and the second rotating shaft 62. The first rotating cylinder 8 and the second rotating cylinder 10 have the same structure.

Figure 6:
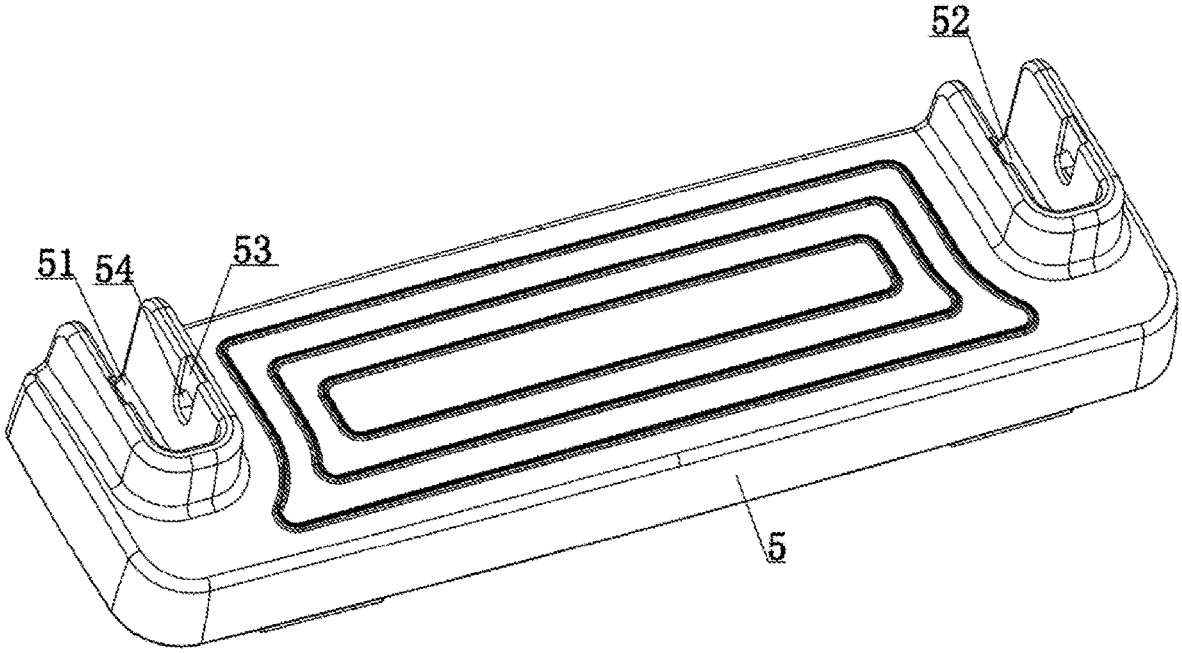
FIG. 6 is a structural diagram of a bottom plate of the present invention.
Figure 7:
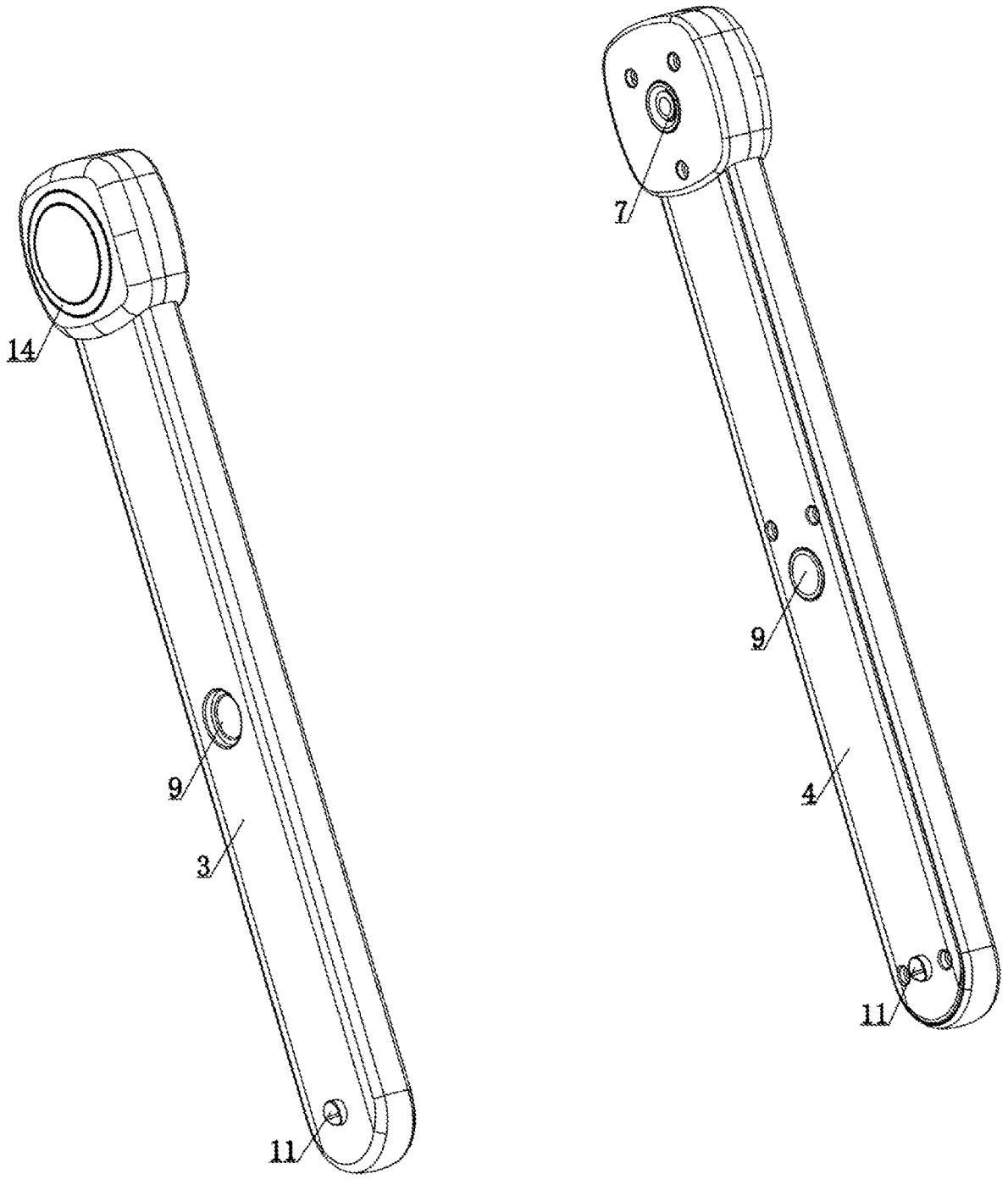
FIG. 7 is a structural diagram of a left support rod and a right support rod of the present invention.
Figure 8:
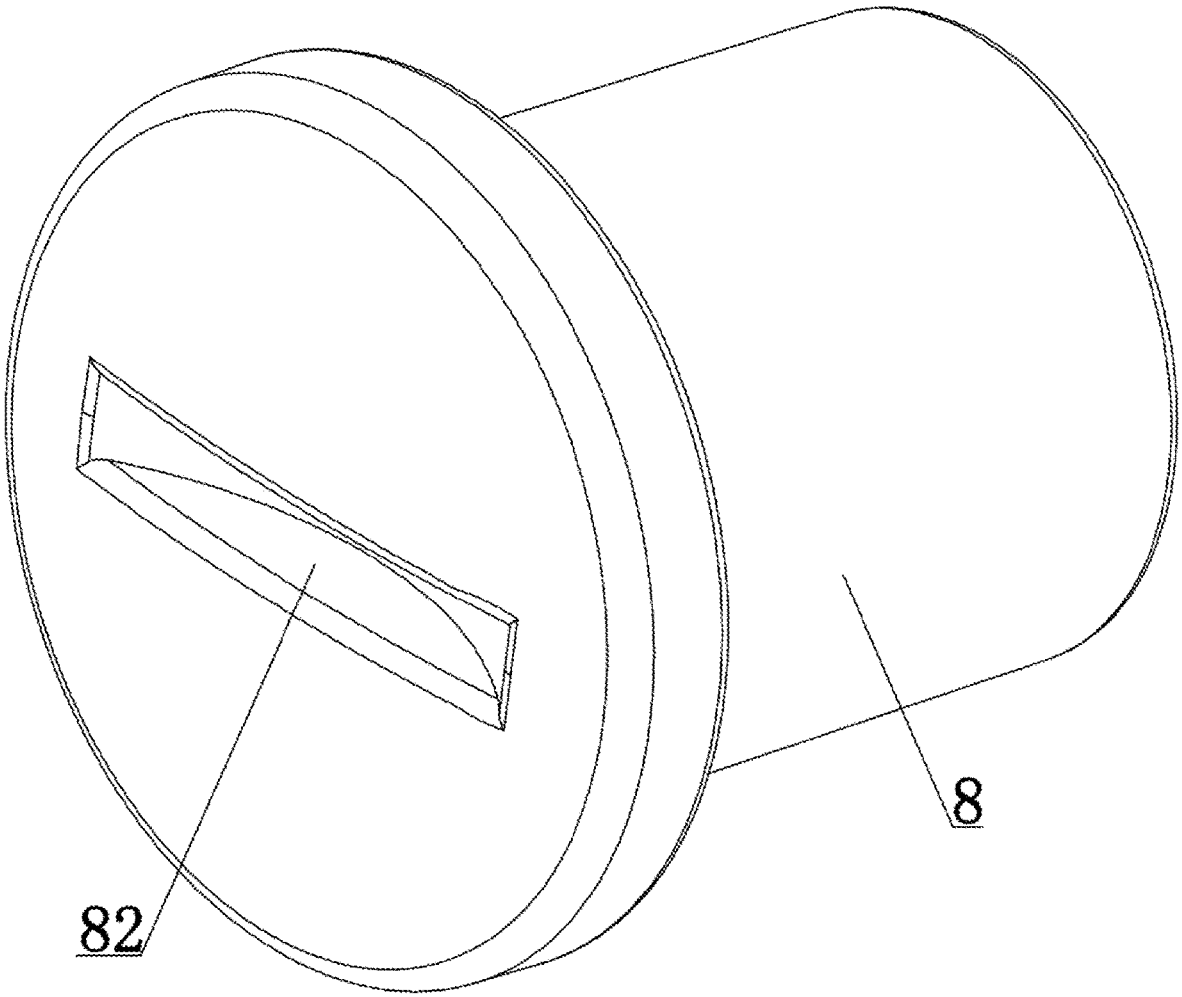
FIG. 8 is a structural diagram of a first rotating cylinder of the present invention.

Referring to FIGS. 1, 6 and 7, the bottom plate 5 is provided with the left receiving groove 51 and the right receiving groove 52. The rear end of each of the left receiving groove 51 and the right receiving groove 52 is an open structure. The bottom of the left support rod 3 and the bottom of the right support rod 4 are located in the left receiving groove 51 and the right receiving groove 52, respectively. Each of both side surfaces of each of the left receiving groove 51 and the right receiving groove 52 is provided with the groove 53 and the engaging hole 54. The engaging hole 54 is located beneath the groove 53 and connected to the groove 53. Each of both side surfaces of each of the left support rod 3 and the right support rod 4 is provided with the engaged part 11 engaged with the corresponding engaging hole 54. The lower end surface of the engaged part 11 is rounded to facilitate engaging the engaged part 11 into the engaging hole 54.

Referring to FIGS. 1, 2, 4 and 7. The top surface of the pedal 6 is provided with anti-slip protrusions 64, and the anti-slip protrusions 64 are configured to prevent the feet from slipping. Each of the left top surface and the right top surface of the seat cushion ring 1 is provided with the wave-shaped handle 12. The top surface of the seat cushion ring 1 is provided with the PU pad 13. The top outer end surface of each of the left support rod 3 and the right support rod 4 is provided with the decorative ring 14 fastened thereto.

The design principle of the present invention is as follows. Referring to FIG. 1, the bottom plate 5 is placed on the floor and the seat cushion ring 1 is placed on the toilet, so that children can sit on the seat cushion ring with their feet on the pedal 6 for urination or defecation, rather than dangling their feet on the floor, which avoids the safety problem caused by the relatively large seat of the toilet when the child sits on the seat cushion ring 1. When the toilet step stool is not in use, the left support rod 3 and the right support rod 4 can be rotated to be perpendicular to the bottom plate 5, and then the seat cushion ring 1 and the pedal 6 are rotated to an appropriate position where the toilet step stool is minimum in size, thereby minimizing the space occupied.

The above is merely a specific embodiment of the present invention, but the design concept of the present invention is not limited thereto. Using this concept to make non-substantive changes to the present invention shall belong to an infringement to the scope of protection of the present invention.

What is claimed is:

1. A folding toilet step stool, comprising:

a seat cushion ring and an elevated ladder;

wherein the elevated ladder comprises a left support rod, a right support rod, a bottom plate and a pedal;

a front portion of the seat cushion ring is hinged to an upper portion of the left support rod and an upper portion of the right support rod;

a bottom of the left support rod and a bottom of the right support rod are hinged to the bottom plate;

the pedal is hinged between a middle of the left support rod and a middle of the right support rod;

the left support rod and the right rod are disposed obliquely;

a length of a front portion of the pedal is greater than a length of a rear portion of the pedal;

two abutting surfaces are formed at junctions of the front portion of the pedal and the rear portion of the pedal;

a front side surface of the left support rod and a front side surface of the right support rod abut against the two abutting surfaces, respectively, the bottom plate is provided with a left receiving groove and a right receiving groove;

a rear end of each of the left receiving groove and the right receiving groove is an open structure;

the bottom of the left support rod and the bottom of the right support rod are located in the left receiving groove and the right receiving groove, respectively;

each of both side surfaces of each of the left receiving groove and the right receiving groove is provided with a groove and an engaging hole;

the engaging hole is located beneath the groove and connected to the groove;

each of both side surfaces of each of the left support rod and the right support rod is provided with an engaged part engaged with the engaging hole; and a lower end surface of the engaged part is rounded.

2. The folding toilet step stool of claim 1, wherein a first rotating shaft is disposed inside a top of each of the left support rod and the right support rod, and the first rotating shaft is provided with a first threaded section;

a front portion of each of a left side surface and a right side surface of the seat cushion ring is provided with a first rotating cylinder, and the first rotating cylinder is provided with a first threaded hole;

a first end of the first rotating cylinder on the left side surface of the seat cushion ring extends into the top of the left support rod and a first end of the first rotating cylinder on the right side surface of the seat cushion ring extends into the top of the right support rod;

the first threaded section is correspondingly screwed to the first threaded hole; and an end surface at a second end of the first rotating cylinder is provided with a first straight slot.

3. The folding toilet step stool of claim 2, wherein a top outer end surface of the left support rod is provided with a first decorative ring fastened to the left support rod, and a top outer end surface of the right support rod is provided with a second decorative ring fastened to the right support rod.

4. The folding toilet step stool of claim 1, wherein each of the middle of the left support rod and the middle of the right support rod is provided with a stepped through hole;

a middle of each of a left side surface and a right side surface of the pedal is provided with a second rotating shaft, and the second rotating shaft is provided with a second threaded section;

a second rotating cylinder is disposed in the stepped through hole, and the second rotating cylinder is provided with a second threaded hole;

one end of the second rotating shaft extends into the stepped through hole;

the second threaded section is correspondingly screwed to the second threaded hole; and an outer end surface of the second rotating cylinder is provided with a second straight slot.

5. The folding toilet step stool of claim 1, wherein a top surface of the pedal is provided with anti-slip protrusions.

6. The folding toilet step stool of claim 1, wherein each of a left top surface and a right top surface of the seat cushion ring is provided with a wave-shaped handle, and a top surface of the seat cushion ring is provided with a polyurethane (PU) pad.

* * * * *